United States Patent [19]

Beckett

[11] Patent Number: 4,936,935

[45] Date of Patent: Jun. 26, 1990

[54] MICROWAVE HEATING MATERIAL

[75] Inventor: Donald G. Beckett, Acton, Canada

[73] Assignee: Beckett Industries Inc., Oakville, Canada

[21] Appl. No.: 436,631

[22] Filed: Nov. 15, 1989

Related U.S. Application Data

[62] Division of Ser. No. 354,217, May 19, 1989.

[30] Foreign Application Priority Data

May 20, 1988 [GB] United Kingdom ..... 8811918
Aug. 1, 1988 [GB] United Kingdom ..... 8818241
Aug. 23, 1988 [GB] United Kingdom ..... 8819984

[51] Int. Cl.[5] ..... B44C 1/14

[52] U.S. Cl. ..... 156/239; 156/235; 428/209; 428/211; 428/464; 428/913; 426/107; 426/113; 426/126; 426/234; 426/243

[58] Field of Search ..... 428/209, 464, 913, 211; 426/107, 113, 126, 234, 243; 156/319, 277, 233, 235, 239

[56] References Cited

U.S. PATENT DOCUMENTS 4,676,857 6/1987 Schan et al. ..... 426/107

OTHER PUBLICATIONS

John Wiley and Sons, The Wiley Encyclopedia of Packaging Technology, 1986, 451–464.

*Primary Examiner*—Ellis P. Robinson
*Assistant Examiner*—Jackie Weddington
*Attorney, Agent, or Firm*—Sim & McBurney

[57] ABSTRACT

Novel laminate structures incorporating a thin metal layer which is of a thickness capable of converting incident microwave energy into thermal energy. The thin metal layer produces a greater heating effect than is produced by the same metal layer directly supporated on a polymeric film layer. The laminate is useful in the microwave heating of a variety of food products.

9 Claims, No Drawings

MICROWAVE HEATING MATERIAL

This is a division of application Ser. No. 354,217 filed May 19, 1989.

The present invention relates to microwave heating material.

BACKGROUND TO THE INVENTION

It is well known that a thin metal film can convert microwave energy into thermal energy for heating a variety of food products. One prevalent use of such material is in the microwave popping of corn.

Such thin metal film, usually aluminum, is provided on a support which is a polymeric film and discrete patches of such thin metal film generally are provided thereon by selective demetallizing of a metallized polymeric sheet, such as by using any of the procedures described in U.S. Pat. Nos. 4,398,994, 4,552,614 and 4,610,755, the disclosures of which are incorporated herein by reference.

When microwave energy is applied to the metal film supported by the polymeric substrate, distortion occurs and the metal film becomes ineffective. It is necessary, therefore, to laminate the plastic film to a suitable non-conductive, heat-stable layer to prevent such distortion from occurring during application of microwave energy.

A search conducted in the facilities of the United States Patent and Trademark Office with respect to this invention has revealed the following prior art:

3,984,598 Sarazin
4,592,914 Kuchenbecker
4,641,005 Seiferth
4,661,671 Maroszek
4,676,857 Scharr et al.
4,702,963 Phillips et al.
4,703,148 Mikulski et al.
4,716,061 Winter In addition, the applicant is aware of U.S. Pat. Nos. 3,235,395 and 4,349,402.

U.S. Pat. Nos. 3,325,395 and 4,349,402 describe metal transfer processes for applying metallic coatings to a variety of substrates, including paper, for the purpose of providing a shiny coating. These references are silent as to any potential application to microwave energy converting their metallic films.

U.S. Pat. No. 3,984,598 describes the production of metal-clad laminates for use in electrical components. Again, no reference is made to any potential application to microwave susceptor films.

U.S. Pat. Nos. 4,592,914, 4,641,005, 4,661,671, 4,702,963, 4,703,148 and 4,716,061 describe a variety of food containers having a layer of microwave susceptor material incorporated into the structure. No mention is made of the employment of a transfer process in the formation of the microwave heat susceptor layer.

U.S. Pat. No. 4,676,857 describes a method of making microwave heating material. In the procedure described in that patent, a pre-selected metallized pattern is disposed on a layer of dielectric material using a hot stamping transfer process in conjunction with aluminum roll leaf. The metal employed is of a thickness that enables microwave energy incident thereon to be converted to thermal energy.

SUMMARY OF INVENTION

In accordance with the present invention, it has now surprisingly been found that when the thin metal film is transferred off the polymeric substrate onto a suitable non-conductive, heat-stable substrate, then a much more powerful heating effect is obtained from the thin metal film when exposed to microwave energy.

The reason for this effect is not known but it is thought that, when the thin metal film is supported on a polymeric substrate, there is some slight distortion introduced to the metal film by some minor contraction of the polymeric film upon heating up under the influence of microwave energy, even though laminated to a heat-stable substrate, and it is this distortion which decreases its effectiveness. Once transferred off the polymeric substrate, such distortion does not occur and a considerably-enhanced heating effect is achieved.

This discovery has lead to the provision of a number of novel products in accordance with the present invention, useful in the microwave heating of a variety of food products, including popping corn, pizzas and french fries.

Accordingly, in one aspect of the present invention, there is provided a novel laminate structure comprising a non-conductive heat-stable substrate layer, a metal layer supported on said substrate layer and having a thickness such as to convert a portion of microwave energy incident thereon to thermal energy, and a lacquer layer coincident with the substrate layer and completely overlying the metal layer and substrate layer.

The present invention is distinguished from U.S. Pat. No. 4,676,857 described above. The patent does not make any mention of the dramatic increased heating effect which is obtained by transferring the metal off the polymeric substrate. In addition, the present invention does not use a hot stamping process to form a preselected pattern on the substrate, such as is required in this prior art.

GENERAL DESCRIPTION OF INVENTION

In the present invention, there is provided a laminate comprising a metal layer of heat susceptor thickness bonded to a non-conductive, heat stable substrate layer, such as a paper or paperboard sheet, overlaid with an outer lacquer layer.

The laminate of the invention may be formed in any convenient manner. In one embodiment of the invention, a polymeric substrate, usually a polyester, is first coated with a lacquer or other convenient material.

Usually, the lacquer is applied as a uniform layer to the polymeric substrate. However, the lacquer also may be applied as a pattern to the substrate. This arrangement may be employed when it is desired to achieve differential degrees of heating within the same structure, with greater heat generated where the metal overlies the lacquer in comparison to the heat generated where the metal adheres directly to the polymeric substrate.

If desired, the polymeric substrate first may be printed with any desired graphics before application of the lacquer over the ink. In this embodiment, the polymeric substrate first may be treated to improve adhesion of the graphics to the polymeric substrate and generally is transparent, so that the graphics can be viewed through the polymeric substrate.

The lacquer layer may be constructed by any desired heat-sensitive material which will form a smooth coating on a polymeric film substrate and on which may be deposited a thin metal layer. Suitable materials include vinyl lacquers.

The lacquer preferably is a heat-sealable material, and may be a material having poor adhesion to the polymeric substrate where it is desired to remove the polymeric substrate.

A metal film then is formed on the outer surface of the lacquer. The method employed comprises any convenient film-forming procedure, consistent with the metal employed. For example, for aluminum conventional vapor deposition is the most convenient. The metal film may comprise any electroconductive metal which is capable of converting microwave energy to thermal energy in the form of thin films. The metal film may comprise aluminum, copper or stainless steel.

The thickness of the metal film applied to the lacquer should be such that the metal film converts a portion of microwave energy incident thereon to thermal energy. The thickness varies with the metal employed. For aluminum, the metal film generally has a thickness corresponding to an optical density of about 0.08 to about 0.8.

The metal-coated material may be selectively demetallized to provide a pattern of metal of desired form. Suitable selective demetallization procedures are described in the aforementioned U.S. Pat. Nos. 4,398,994, 4,552,614 and 4,610,755. The metal-coated material next is adhered to a non-conductive, heat stable sheet. This sheet may comprise structural fibrous stock material, particularly paper or paperboard by conventional laminating procedures using a suitable laminating adhesive, such as a thermosetting resin.

The resulting laminate in the regions where the metal film is adhered to the lacquer, generates more heat upon application of microwave energy than does the corresponding metal film directly coated on the polymeric substrate layer.

The laminate may be employed as such. It is preferred, however, to separate the polymeric substrate layer from the laminate to enable the polymeric substrate layer to be reused in subsequent transfer operations. The laminate of lacquer on metal laminated to paper or other heat-stable layer exhibits greater heating ability than does the corresponding metal film directly coated on a polymeric film. The laminate may be printed with desired graphics.

The laminate of the present invention may be employed for a variety of purposes where heating of a foodstuff by utilization alone or by incorporation into a packaging structure, with the foodstuff to be heated being placed on the metallized area.

DESCRIPTION OF PREFERRED EMBODIMENT

In one embodiment of the invention, the laminate may be formed into a package, for example, for microwave popping of popcorn or heating french fries, with the metal portion on the exterior of the package and a grease-proof paper interior, usually with the metal printed over with desired graphics.

In addition, the laminate may be further laminated with other paper sheets from which the packaging material is formed. The laminate may be provided in the form of an elongate strip with longitudinally-spaced metallized regions, which then may be laminated to one or between two outer paper sheets to form a further laminate from which packaging material may be formed. In this way, the elongate strip may replace the elongate strip of metallized polymeric film used commercially in microwave popcorn bags. Not only is greater heat attained thereby for the same metal thickness but also a cheaper structure is provided by substitution of paper for the polymeric material.

In addition, the novel laminate also may be laminated to one or more conventional polymeric films having a patterned metal film thereon, on the opposite side of the paper or paperboard from the thermoset resin, by any convenient laminating procedure. Alternatively, an additional metal layer may be provided on the uncoated side of the paper sheet in identical manner to that formed on the first side. In both cases, the metal film is of a thickness so as to convert a portion of microwave energy incident thereon to thermal energy.

Multiple metal films produce a synergistic heating effect, as described in my copending U.K. application No. 8815852.2 filed July 4, 1988 and entitled "Multiple Layer Heating Element", the disclosure of which is incorporated herein.

In one embodiment of the present invention, the laminate is incorporated into a pizza bag which permits pizza to be reheated by microwave energy while producing browning of the crust. The lower base of the bag is formed of or incorporates the laminate with the metal region corresponding to the pizza pie dimensions while the upper bag closure incorporates a heavier metal layer which is reflective of microwave energy usually with an optical density greater than 1.0 for aluminum, either supported by a polymeric layer or preferably a paper layer. By this arrangement, when the bag with a pizza in it is exposed to microwave radiation, the heavy metal layer prevents radiation from passing through the top of the bag to the pizza, but rather displaces the radiation to the bottom of the bag, assisting the light metal layer in the laminate to heat up, and thereby heat the pizza and crispen the crust.

In another particular structure provided in accordance with this invention, and particularly useful in the microwave reconstitution or heating of french fries or similar foodstuffs, the container is formed wholly of the laminate except in the seal area and where the foodstuff does not usually engage the surface, from which the metal is omitted.

Depending on the desired end use of the product, the optical density of the metal film may vary with different locations of the substrate surface, so as to provide different degrees of heating from the different locations, for example, in the french fries bag described above. The provision of different optical densities of metal film may be achieved by screening, as described in copending U.S. patent application Ser. No. 010,182 filed Feb. 2, 1987, the disclosure of which is incorporated herein by reference.

In addition, as noted above, differential degrees of heating may be achieved by providing a structure in which a conventional metallized polymeric film is combined with the novel structure to achieve enhanced heating in the area of the novel structure and a lesser degree of heating in the areas of the conventional metallized film.

For example, a heating tray for pizza may be provided. A metallized polymeric film having a metal thickness sufficient to convert incident microwave energy into thermal energy is laminated to paper. The laminate then is laminated to the paper side of a laminate of the invention having peripheral metallized regions and an outer polymeric layer, which then is removed.

The composite laminate then is laminated on the lacquer side to a stiff card substrate. The final laminate, therefore, has a metallic circle corresponding to the pizza size overlying an annulus of metal. In this way, greater heat is generated in the peripheral region of the base that is the central region, to achieve differential degrees of heating of the pizza upon the application of microwave energy thereto, so as to result in a microwave reconstituted pizza, wherein the crust is crisp and the filling is of an even temperature.

EXAMPLE

A sample of an aluminized polymeric film in which the metal film had an optical density of 0.25 was laminated to a paper substrate and exposed to microwave energy.

A laminate was formed by coating a polymeric film layer with a polyvinyl metallic layer, aluminizing the vinyl lacquer layer to an optical density of 0.27 to 0.35, laminating the aluminum layer to a paper substrate and removing the polymeric film layer. This laminate was exposed to microwave energy.

The temperature attained by exposing the two structures with the same intensity of microwave energy for the same time period was compared, as seen in the following table:

TABLE

| Time of Heating (secs) | Temperature Attained (°C.) Invention | Prior Art |
|---|---|---|
| 0 | 25° C. | 25° C. |
| 10 | 161° C. | 127° C. |
| 20 | 164° C. | 125° C. |
| 30 | 192° C. | 144° C. |
| 60 | 196° C. | 176° C. |

As may be seen from this data, the laminate in accordance with the present invention produced more heating from the microwave energy than the prior art structure.

SUMMARY OF DISCLOSURE

In summary of this disclosure, the present invention provides a novel laminate arrangement comprising a thin film of conductive metal which is of a thickness capable of converting microwave energy into thermal energy laminated to a supporting paper, paperboard or other dielectric material substrate, formed by transfer from a polymeric film substrate. Modifications are possible within the scope of this invention.

What I claim is:

1. A method of forming a laminate structure, which comprises the sequential steps of:

first applying a layer of lacquer to a polymeric substrate, then forming a metal film on an outer surface of the lacquer layer of a thickness such that incident microwave energy is converted thereby to thermal energy, and then laminating the metal film to a non-conductive heat-stable sheet.

2. The method of claim 1 wherein the lacquer is applied in a pattern to the polymeric substrate, whereby differential degrees of heating may be obtained from the laminate structure.

3. The method of claim 2 wherein the polymeric substrate is printed with ink in a graphic prior to application of the lacquer layer over the ink.

4. The method of claim 3 wherein the polymeric substrate is pretreated to improve adhesion of the graphic to the polymeric substrate.

5. The method of claim 1 wherein the metal layer is deposited over said lacquer layer coincident with the polymeric substrate in a thickness sufficient to convert microwave energy incident thereon to thermal energy.

6. The method of claim 5 including selectively demetallizing the metal layer to provide a metal pattern on said lacquer layer.

7. The method of claim 1 wherein said non-conductive heat-stable sheet is paper.

8. The method as claimed in claim 1, including the subsequent step of removing the polymeric substrate from the lacquer layer.

9. The method as claimed in claim 8, including, subsequent to said removal of said polymeric substrate from the lacquer layer, laminating the lacquer layer to a paper layer.

* * * * *